US005716246A

United States Patent [19]

Kerckhof et al.

[11] Patent Number: 5,716,246

[45] Date of Patent: Feb. 10, 1998

[54] CONTACT DEVICE FOR ELECTRIC PLUG CONNECTIONS

[75] Inventors: Bart Kerckhof, Oostkamp, Belgium; Artur Wohlfart, Bad Durkheim, Germany

[73] Assignee: Siemens Aktiengesellschaft, Munich, Germany

[21] Appl. No.: 548,741

[22] Filed: Oct. 26, 1995

[30] Foreign Application Priority Data

Oct. 26, 1994 [DE] Germany ..... 9417197 U

[51] Int. Cl.[6] ..... H01R 9/24

[52] U.S. Cl. ..... 439/884

[58] Field of Search ..... 439/884, 885, 439/888, 889, 866, 948, 891

[56] References Cited

U.S. PATENT DOCUMENTS 5,207,603 5/1993 Peloza ..... 439/884

5,295,871 3/1994 Lapraik et al. ..... 439/891

FOREIGN PATENT DOCUMENTS 0378466 12/1993 European Pat. Off. .

2611996 9/1988 France ..... 439/888

*Primary Examiner*—Neil Abrams

*Assistant Examiner*—Barry Matthew L. Standig

*Attorney, Agent, or Firm*—Herbert L. Lerner; Laurence A. Greenberg

[57] ABSTRACT

A contact device for electric plug connections includes a stamped and bent part having an intermediate region with a U-shaped cross section, two side walls and a base wall joining the side walls. A line connection element is disposed at one end of the contact device. A contact prong defines a contact side and has a base protruding from the intermediate region at another end of the contact device. The contact prong is thicker than remaining regions of the contact device. The base wall and/or side walls of the U-shaped intermediate region have connecting elements, such as extensions and/or attachments on the contact side being form-lockingly joined to the contact prong by form stamping and/or bending in the vicinity of the base of the contact prong.

14 Claims, 4 Drawing Sheets

CONTACT DEVICE FOR ELECTRIC PLUG CONNECTIONS

BACKGROUND OF THE INVENTION

Field of the Invention

The invention relates to a contact device for electric plug connections, including a stamped and bent part having an intermediate region of U-shaped cross section with two side walls and a base wall joining them, a line connection element on one end of the contact device, and a contact prong protruding from the intermediate region on the other end of the contact device, wherein the contact prong is thicker than remaining regions of the contact device.

Aside from a detent engagement in a plug housing through the use of an overspring in certain kinds of applications, such contact devices formed with a prong contact in general are otherwise supported floatingly in the plug housing. Guidance of the prong contact region of the contact device is therefore necessary for accurate alignment with a socket contact. Since on one hand an optionally used overspring and on the other hand the guide length require a certain length of the prong contact, the danger exists of damage to the prong contact, for example from incorrect bending and therefore bending out of the plugging direction, especially under the rough conditions prevailing in the workplace and in installation. A certain security against such damage is attained, in contact devices in present use, for instance by providing that a wire-like contact prong, for instance with a cross section of 0.63×0.63 mm, is welded to a contact device that is made by stamping it from band material and bending it.

A contact device of the type referred to at the outset is known from Published European Patent Application 0 378 466 B1. In that contact device, which is made by cutting it out of a metal plate and folding it, wherein the metal plate has two strips of different thickness, the contact prong and the portion of the U-shaped body adjoining it have a thickness that is greater than the thickness of the remainder of the contact device. In that way the stability in the region of its binding to the U-shaped body can be improved.

SUMMARY OF THE INVENTION

It is accordingly an object of the invention to provide a contact device for electric plug connections, which overcomes the hereinafore-mentioned disadvantages of the heretoforeknown devices of this general type and which provides a simple way of attaining improved security of a contact prong against damage and especially from being bent out of a plugging direction.

With the foregoing and other objects in view there is provided, in accordance with the invention, a contact device for electric plug connections, comprising a stamped and bent part having two ends; an intermediate region with a U-shaped cross section, two side walls and a base wall joining the side walls; a line connection element at one of the ends; and a contact prong defining a contact side and having a base protruding from the intermediate region at the other of the ends, the contact prong being thicker than remaining regions of the contact device; the base wall and/or side walls of the U-shaped intermediate region having connecting elements, such as extensions and/or attachments on the contact side being form-lockingly joined to the contact prong by form stamping and/or bending in the vicinity of the base of the contact prong.

In this kind of contact device, the contact prong is secured by form-locking with connecting elements of the intermediate region at the point at which it is most greatly threatened with being bent out of shape, namely in the region of its base that is bound to the U-shaped intermediate region. A form-locking connection is one which connects two elements together due to the shape of the elements themselves, as opposed to a force-locking connection, which locks the elements together by force external to the elements. This security can be attained in a simple way, because of its form-locking character, without additional effort or expense, simultaneously with the production of the contact device as a stamped and bent part, since the connecting elements provided for that purpose can be stamped and bent in the same production operation. As a result of the form-locking connection of the connecting elements to the contact prong, this prong is reinforced and rigidified in the region of its base.

In accordance with another feature of the invention, this stabilization suitably takes place not directly at the point where the contact prong is bound to the intermediate region, but rather somewhat offset from it toward the free end of the contact prong. As a result, the connecting elements are attached up to the point of the form-locking connection to a certain lever arm, which advantageously laterally supports the contact prong and further improves its rigidity.

Various possibilities are conceivable for the form-locking connection of the connecting elements of the intermediate region to the contact prong.

For instance, in accordance with a further feature of the invention, the form-locking connection can be brought about by having the connecting elements encompass the contact prong in claw-like fashion.

In accordance with an added feature of the invention, the formation of a guide slit for the contact prong is also possible and the guide slit can be formed by two extensions laterally contacting the contact prong and being form-lockingly joined to the contact prong through the use of embossing, claw engagement, form stamping and/or bending.

Finally, in accordance with a concomitant feature of the invention, it is also possible to have an extension of the intermediate region reach into the contact prong from the side.

Other features which are considered as characteristic for the invention are set forth in the appended claims.

Although the invention is illustrated and described herein as embodied in a contact device for electric plug connections, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 3–6 are perspective views of four embodiments of a contact device with guidance of the contact prong, wherein FIG. 3 shows a form-locking connection of the contact prong which is brought about by embossing and FIGS. 4, 5 and 6 show it being brought about by a claw engagement.

DESCRIPTION OF THE PREFERRED EMBODIMENTS

Figure 1:
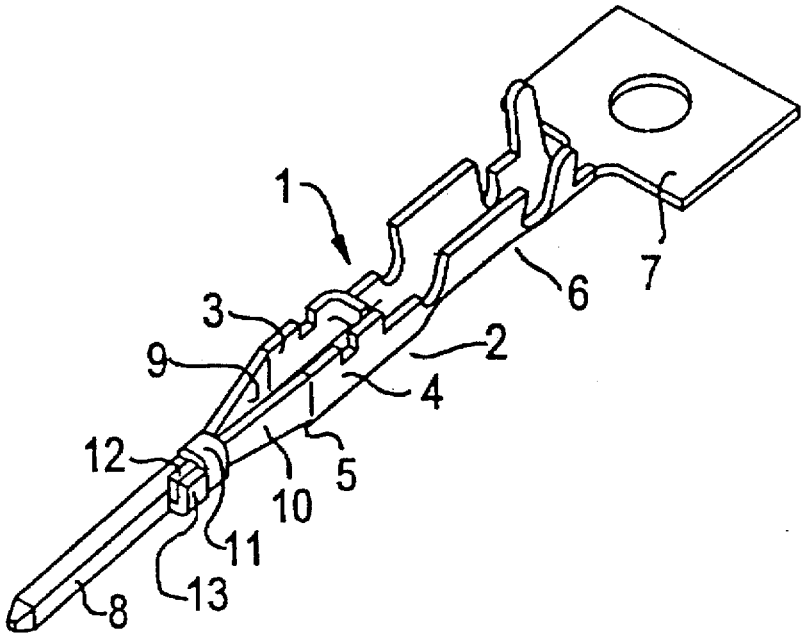
FIGS. 1 and 2 are diagrammatic, perspective views of two different embodiments of a contact device with a form-locking connection of a contact prong brought about purely by a claw engagement.

Referring now to the figures of the drawing as a whole, it is seen that in all of the embodiments shown in FIGS. 1–7, an entire contact device 1 shown in the drawing is manufactured from a stamped bent part, and for all of the embodiments its fundamental construction is the same. Accordingly, the contact device 1 has an intermediate region 2 of U-shaped cross section with first and second side walls 3, 4 and a base wall 5 joining them, as well as a line connection element 6, for instance being constructed as a crimp element, with an adjoining perforated plate 7 on one end of the contact device, and a contact prong 8 protruding from the intermediate region 2 on the other end of the contact device. In each case, the contact prong is thicker than remaining regions of the contact device that have a material thickness which is consistently 0.25 mm, for example. By comparison, the contact prong 8 which is of square cross section, for instance, in this case has a thickness of approximately 0.6×0.6 mm, for instance. In all of the embodiments, the contact prong 8 protruding to the front on the contact side from the intermediate region 2 is reinforced in the region of its base bordering to the intermediate region, so that it is secured against being bent out of a plugging direction.

Referring now, particularly, to FIG. 1, there is seen a contact device 1 in which the first and second side walls 3, 4 of the U-shaped intermediate region 2 are constructed with first and second strip-like extensions 9, 10 that converge toward one another on the contact side beyond the U-shaped profile. The extension 9 of the side wall 3 carries the contact prong 8, and it is provided with a lateral tab-like attachment 11 in the region of a transition to the contact prong. The extension 10 of the side wall 4 is somewhat longer than the opposite extension 9 and rests laterally on the contact prong 8. The height of a side wall of the extension 10 in this region is approximately equivalent to the thickness of the contact prong. In the final state of the contact device 1, the lateral tab-like attachment 11 of the extension 9 is bent around the contact prong 8 and the opposite extension 10, so that it encompasses the extension in claw-like fashion and presses it against the contact prong. A free end 12 of the extension 10 protrudes out of this claw configuration, and this free end is encompassed in claw-like fashion by an additional lateral, tab-like, angularly bent attachment 13 of the contact prong and is pressed additionally against the contact prong. In this way, in a pure claw engagement, a form-locking connection with the contact prong 8 is brought about, which as a result is reinforced in the region of the base protruding from the intermediate region 2. In the exemplary embodiment shown, the extensions 9, 10 with their lateral attachment 11 and free end 12 and the lateral attachment 13 have a uniform material thickness that matches that of the remaining regions of the contact device 1 and by way of example is 0.25 mm.

Figure 2:
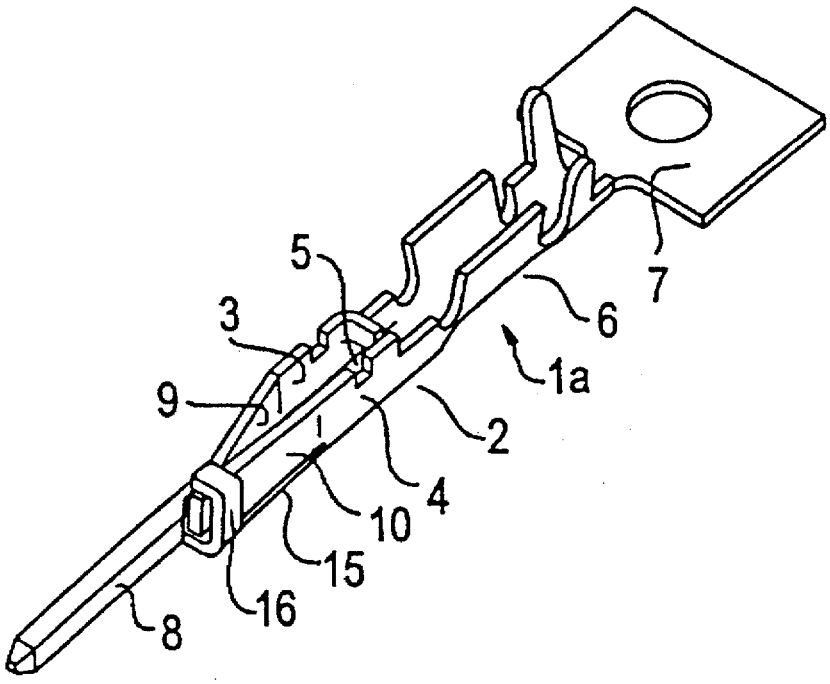

In a contact device 1*a* of FIG. 2, both side walls 3, 4 of the U-shaped intermediate region 2 are also constructed with strip-like extensions 9, 10, which once again converge toward one another on the contact side beyond the U-shaped profile. In this case as well, the base wall 5 of the intermediate region 2 beyond the U-shaped profile is provided with a strip-like extension 15, which extends beyond the binding of the contact prong 8. The contact prong 8 is again carried by the extension 9 and is formed with a lateral tab-like attachment 16, which is oriented transversely to the contact prong. This attachment 16 is bent at an angle by bending operations in such a way that it encompasses the extension 10 in claw-like fashion and presses it against the contact prong 8.

FIGS. 3–6 show other exemplary embodiments of a form-locking connection of connecting elements of the intermediate region 2 of contact devices 1*b* through 1*e* having the contact prong 8. In all of the embodiments of FIGS. 3–6, the side wall 3 in the intermediate region 2 again has an extension 9 that extends beyond the U-shaped profile and carries the contact prong 8. Moreover, the base wall 5 of the intermediate region 2 is again constructed with an extension 15 extending beyond the U-shaped profile. This extension is thicker than the base wall, and preferably as thick as the contact prong itself, from approximately the location of the binding of the contact prong to the extension 9 of the side wall 3 onward. Adjoining a thicker region 20 that extends beyond the binding point of the contact prong to the extension 9, the extension 15 is constructed with attachments in the form of two guide legs 21*b*, 22*b* and is bent in the shape of an L. Between them, these guide legs form a guide slit 23*b* for the contact prong 8 and they rest laterally thereon. A form-locking connection of the guide legs 21*b*, 22*b* to the contact prong 8 is brought about on the free end of the guide legs.

Figure 3:
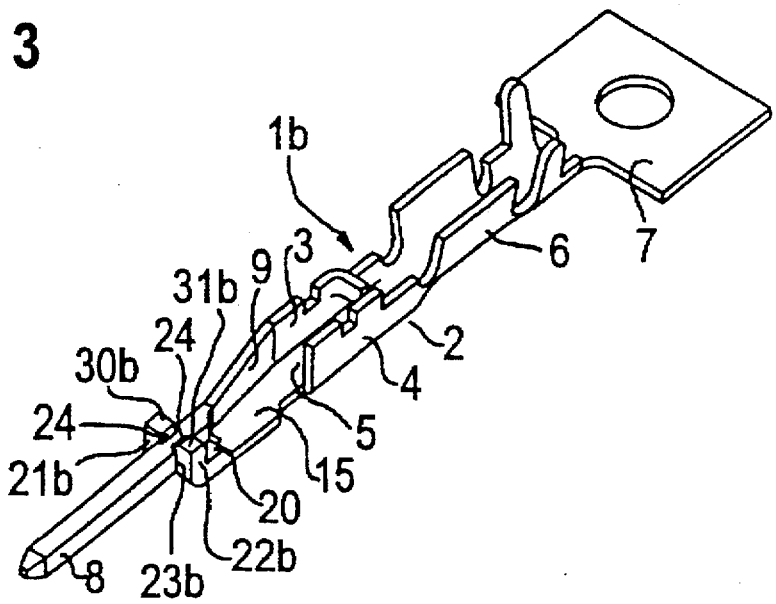

In the exemplary embodiment of FIG. 3, the form-locking connection is created by bosses 24 on mutually facing surfaces of free ends 30*b*, 31*b* of the guide legs. These bosses are made in such a way that the contact prong is reinforced at this form-locking connection, which is offset somewhat from its binding at the side wall 3 toward its free end, and is thus secured against bending out of position.

Figure 4:
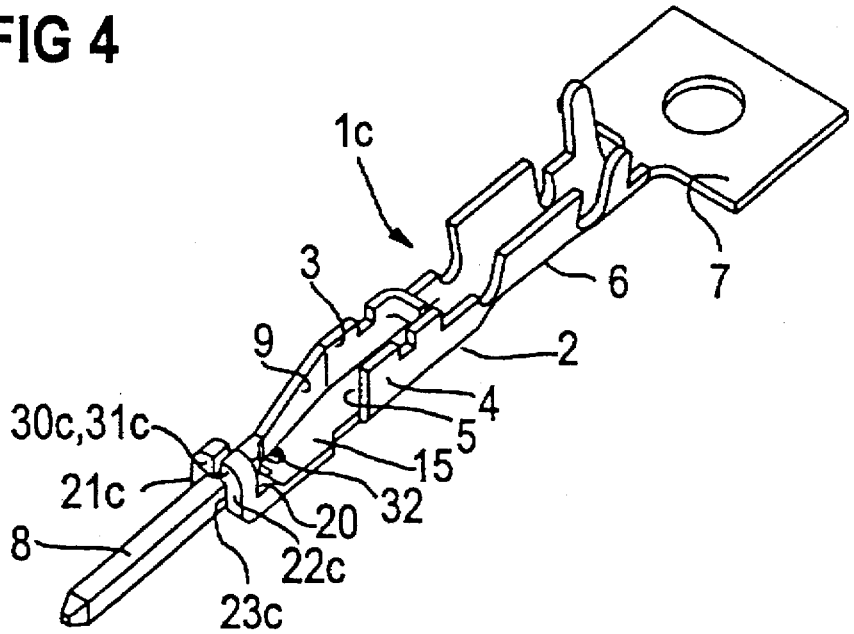
Figure 5:
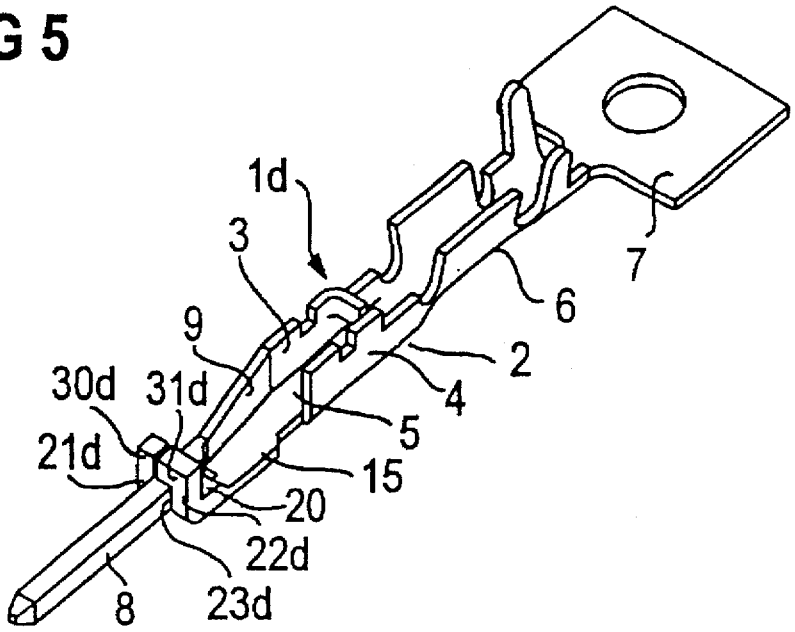
Figure 6:
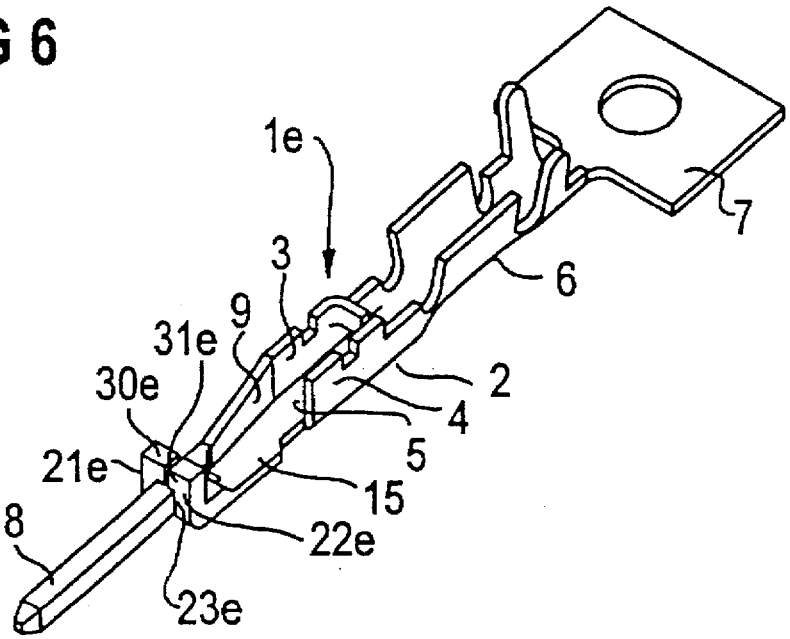

FIGS. 4–6 show the contact devices 1*c*–1*e* which have a guide slit for the contact prong 8 and a form-locking connection of the connecting elements to the contact prong, being brought about by a claw engagement. In the embodiment of the contact device 1*c* of FIG. 4, the side wall 3 is again constructed with an extension 9 that carries the contact prong 8 and extends beyond the U-shaped profiles. The base wall 5 likewise extends in the longitudinal direction of the contact device beyond the U-shaped profile with an extension 15. The extension 15 is bent in an L, and with guide legs 21*c*, 22*c* that between them enclose a stamped guide slit 23*c*, it rests laterally on the contact prong 8. Free ends 30*c*, 31*c* of the guide legs are oriented inward toward one another by tilting or twisting and thus encompass the contact prongs form-lockingly. In the embodiments with a guide slit, the guide slit effects the positional fixation of the contact prong in the lateral direction. This manner of positional fixation can be made quite accurate and reproducible. The positional fixation in the heightwise direction is brought about by a bead 32 in the extension 15 of the base wall 5 and/or by tilting or twisting the free ends 30*c*, 31*c* of the guide legs 21*c*, 22*c*.

The contact device 1*d* of FIG. 5 is largely equivalent to the contact device 1*c* of FIG. 4 but differs from it in the construction of guide legs 21*d*, 22*d* of the extension 15 of the base wall 5, which guide legs form a guide slit 23*d*. The construction differs in such a way that only the front guide leg 22*d* is bent at an angle at its free end 31*d* so that it encompasses the contact prong. Conversely, the rear guide leg 21*d* having a free end 30*d* is not bent at an angle, so that it merely rests laterally against the contact prong with a rectilinear course. The rear guide leg 21*d* has approximately the same height as the front guide leg 22*d*. In this embodiment, the front guide leg 22*d* is produced by form stamping, and the rear guide leg 21*d* is bent upward after the contact prong has pivoted into position.

In the contact prong 1*e* of FIG. 6, which is quite similar to the contact prong 1*c* of FIG. 4, guide legs 21*e* and 22*e* that between them enclose a guide slit 23*e* are bent toward one another at an angle at their free ends, similarly to the guide legs of FIG. 4, so that the two guide legs form-lockingly encompass the contact prong 8 with free ends 30*e*, 31*e* thereof. In this embodiment, the front guide leg 22*e* is produced by form stamping, and in its production as a stamped and bent part the other, rear guide leg 21*e* is bent upward, for the sake of the form-locking connection, after the contact prong 8 has been pivoted into position.

Figure 7:
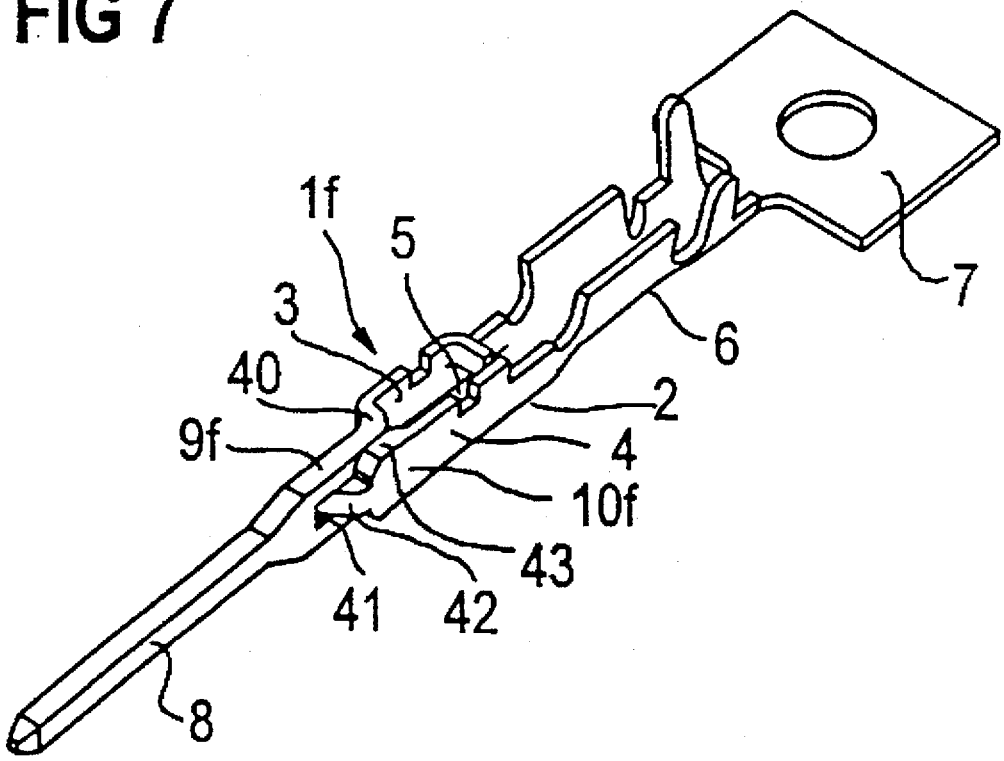
FIG. 7 is a perspective view of a further embodiment of a contact device, with a form-locking connection of the contact prong being brought about through the use of a lateral engagement.

In the case of the contact device 1*f* of FIG. 7, a further option for a form-locking connection of connecting elements of the intermediate region 2 to the contact prong 8 is shown. In this case the side wall 3 of the intermediate region 2 has an extension 9*f* being formed by a right-angle bend 40 adjoining it in the longitudinal direction of the contact device if and extending again beyond the U-shaped profile. This extension is thicker facing away from the right-angle bend 40 than the remaining regions of the contact device 1*f*. On its end, the extension 9*f* narrows in wedge-like fashion and merges with the contact prong. In other words, in this exemplary embodiment, it has the same thickness as the contact prong. The extension 9*f* is provided with a slit-like recess 41. The other side wall 4 of the intermediate region 2 has a straight extension 10*f* which adjoins the side wall 4 in alignment with it, which likewise extends beyond the U-shaped profile and which rests laterally against the right-angle-bent extension 9*f* of the opposite side wall 3 with a thicker region 43 facing away from the right-angle bent 40. A free end of the extension 10*f* merges with a narrow land, rib or connecting part 42. This rib is bent toward the right-angle-bent extension 9*f* and engages the recess 41 thereof. In this way, once again, a reinforcement of the contact prong at a point that is somewhat offset from the binding to the intermediate region 2 is attained. This offset point of the form-locking connection is also clearly apparent from the drawing of the embodiments of FIGS. 3–6.

We claim:

1. A contact device for electrical plug connections, comprising:

a stamped and bent part having two ends and a given thickness;

said stamped and bent part having an intermediate region with a U-shaped cross section, two side walls and a base wall joining said side walls;

a line connection element at one of said ends;

a contact pin defining a contact side and having a base protruding from said intermediate region at the other of said ends, said contact pin being thicker than said given thickness; and at least one of said base wall and side walls of said U-shaped intermediate region having connecting elements on said contact side being form-lockingly joined to said contact pin for providing structural reinforcement of said contact pin.

2. The contact device according to claim 1, wherein said connecting elements are extensions.

3. The contact device according to claim 1, wherein said connecting elements are joined to said contact pin by the process of form stamping.

4. The contact device according to claim 1, wherein said contact pin protrudes from said intermediate region at a binding, said contact pin has a free end, and said form-locking connection of said connecting elements to said contact pin is offset from said binding toward said free end of said contact pin.

5. The contact device according to claim 1, wherein:

a first one of said side walls of said intermediate region has a first extension carrying said contact pin;

a second one of said side walls of said intermediate region has a second extension being bent toward and resting laterally on said contact pin; and said first extension has a tab-like attachment extending crosswise to said contact pin and encompassing said contact pin and said second extension in claw-like fashion.

6. The contact device according to claim 1, wherein:

a first one of said side walls of said intermediate region has a first extension carrying said contact pin;

a second one of said side walls of said intermediate region has a second extension being bent toward and resting laterally on said contact pin; and said base wall has a tab-like attachment extending crosswise to said contact pin, said attachment encompassing said contact pin and said second extension in claw-like fashion.

7. The contact device according to claim 1, wherein said connecting elements are attachments.

8. The contact device according to claim 1, wherein said connecting elements are extensions and attachments.

9. The contact device according to claim 1, wherein said connecting elements are joined to said contact pin by the process of form bending.

10. The contact device according to claim 1, wherein said connecting elements are joined to said contact pin by the processes of form stamping and bending.

11. A contact device for electrical plug connections, comprising:

a stamped and bent part having two ends and a given thickness;

said stamped and bent part having an intermediate region with a U-shaped cross section, two side walls and a base wall joining said side walls;

a line connection element at one of said ends;

a contact pin defining a contact side and having a base protruding from said intermediate region at the other of said ends, said contact pin being thicker than said given thickness;

said base wall of said intermediate region having an extension with bent guide legs resting laterally on said contact pin, said bent guide legs forming a guide slit between said bent guide legs for said contact pin.

12. The contact device according to claim 11, wherein said guide legs have a free end with bosses thereon forming said form-locking connection with said contact pin.

13. The contact device according to claim 11, wherein said guide legs have free ends being tilted or twisted to form said form-locking connection with said contact pin.

14. A contact device for electrical plug connections, comprising:

a stamped and bent part having two ends and a given thickness;

said stamped and bent part having an intermediate region with a U-shaped cross section, a first side wall, a second side wall and a base wall joining said first side wall and said second side wall;

a line connection element at one of said ends;

a contact pin defining a contact side and having a base protruding from said intermediate region at the other of said ends, said contact pin being thicker than said given thickness;

said first side wall of said intermediate region having a first extension being bent at a right angle, carrying said contact pin and having a recess formed therein; and said second side wall of said intermediate region having a second extension being straight with a free end merging into a narrow rib being bent in the direction toward said first extension and engaging said recess.

* * * * *